US008016606B1

(12) United States Patent
Kwan et al.

(10) Patent No.: US 8,016,606 B1
(45) Date of Patent: Sep. 13, 2011

(54) UNSTRESSED CONNECTOR POSITION ASSURANCE DEVICE AND CONNECTOR ASSEMBLY

(75) Inventors: Meng Sang Kwan, Singapore (SG); Vikas Azad, Farmington Hills, MI (US); Ping Chen, Novi, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 12/987,678

(22) Filed: Jan. 10, 2011

(51) Int. Cl.
*H01R 13/627* (2006.01)

(52) U.S. Cl. ..... 439/352

(58) Field of Classification Search ..... 439/352, 439/356, 595, 752, 350, 357, 358, 488
See application file for complete search history.

(56) References Cited

U.S. PATENT DOCUMENTS 4,655,527 A * 4/1987 Vandame ..... 439/350
4,801,275 A * 1/1989 Ikeda et al. ..... 439/350
5,938,470 A * 8/1999 Kashiyama ..... 439/489
5,947,763 A * 9/1999 Alaksin ..... 439/489
6,077,101 A 6/2000 Garretson et al.
6,669,398 B2 * 12/2003 Wada et al. ..... 403/329
6,780,045 B2 * 8/2004 Shuey et al. ..... 439/489
7,326,074 B1 2/2008 Lim et al.
2011/0045683 A1 * 2/2011 Foung ..... 439/352

* cited by examiner

*Primary Examiner* — Tulsidas C Patel
*Assistant Examiner* — Phuong Nguyen
(74) *Attorney, Agent, or Firm* — Osha • Liang LLP

(57) ABSTRACT

A Connector Position Assurance (CPA) device for ensuring mating of a male header connector with a female housing includes a body portion, a first arm, and a second arm. The first arm is attached to the body portion, extended from the body portion, and includes a locking groove proximate a distal end thereof. The second arm, which includes a locking latch, is spaced apart from the first arm, attached to the body portion, and extended from the body portion. When the CPA device is guided along the female housing, the locking groove and the locking latch lock onto complementary protrusions on the female housing in a pre-lock position, only to be dislodged upon contact of a sloped surface at the distal end of the first arm with the male header connector during insertion of the male header connector into the female housing to proceed to a final-lock position.

21 Claims, 6 Drawing Sheets

UNSTRESSED CONNECTOR POSITION ASSURANCE DEVICE AND CONNECTOR ASSEMBLY

BACKGROUND OF INVENTION

Connector Position Assurance (CPA) devices are commonly used in electrical connectors in order to ensure that the connector bodies are properly locked and mated together. Half-mated connections can be avoided by having a pre-locking mechanism that makes it impossible for the CPA device to be pushed into a final locking state unless the electrical connectors are mated in the desired manner.

One conventional method employed in the art to disengage the CPA device from a pre-lock position, as described in U.S. Pat. No. 6,077,101, for example, utilizes a lock in the header side, which, if damaged, may affect the effective locking capability of the primary locking system of the connector. Additionally, as the CPA device is in a stressed state when full mating and locking are accomplished, thermal effects under a long-term influence of high temperature conditions can increase the likelihood of material creep. This can affect material integrity and, ultimately, the functionality of the CPA device.

Disengagement of the CPA device from the pre-lock position can be accomplished through modification of the header to include special disengagement features. However, CPA devices often require standard headers, such as headers conforming to United States Council for Automotive Research (USCAR) footprint. Therefore, in CPA devices where modification of headers is precluded, effective locking requires appropriate design of CPA devices, for example, as shown in U.S. Pat. No. 7,326,074.

SUMMARY OF INVENTION

In general, in one or more aspects, the invention relates to a Connector Position Assurance Device (CPA) device, the use of which reduces stress on the device in both the pre-lock and final-lock positions. The CPA device includes a body portion, a first arm, and a second arm. The first arm is attached to the body portion, extended from the body portion, and includes a locking groove proximate a distal end thereof. The second arm, which includes a locking latch, is attached to the body portion, spaced apart from the first arm, and extended from the body portion. When the CPA device is guided along the female housing, the locking groove and the locking latch lock onto complementary protrusions on the female housing in a pre-lock position, only to be dislodged upon contact of a sloped surface at the distal end of the first arm with the male header connector during insertion of the male header connector into the female housing to proceed to a final-lock position.

In one or more embodiments, the CPA device includes another second arm such that the two second arms are on either sides of the first arm.

In one or more embodiments, the CPA device further includes two guide elements protruding from the body portion, each extending above one of two second arms such that spaces between the arms and the guide elements are formed as channels for translational sliding of complementary portions of the female housing.

In one or more embodiments, the second arm of the CPA device is above the first arm, and both the arms constitute a set. The CPA device includes two sets of arms spaced apart from each other. The second arms belonging to the two sets are connected by a rectangular portion above which the locking latch in the form of a shaped relief is placed. The spaces between the first arms and the second arms of the two sets serve as channels for translational sliding of complementary portions of the female housing.

One or more embodiments of the present invention advantageously improves long-term stability of electrical connectors to reduce deformation, and thereby stress, at both the pre-lock and final-lock positions.

Other aspects and alternative useful embodiments of the invention will be apparent from the following description and the appended claims.

DETAILED DESCRIPTION

Figure 1:
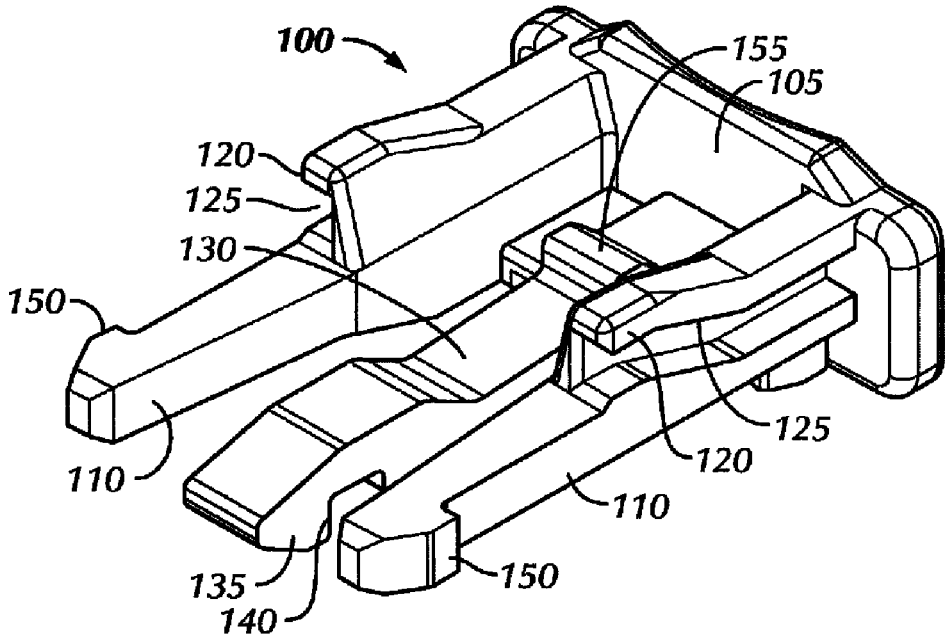
FIG. 1 is a perspective view of a Connector Position Assurance (CPA) device in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

One or more embodiments of the invention overcomes deformation/stress at both pre-lock and final lock positions, without requiring header design modification. Referring to FIG. 1, in accordance with one or more embodiments of the invention, a Connector Position Assurance (CPA) device 100 comprises two parallel arms 110 spaced apart from each other and extending longitudinally from a body portion 105, and perpendicular to the plane of the body portion 105. A pair of guide elements 120, integrally formed over the two parallel arms 110 and the body portion 105, forms a guiding channel 125 with the arms 110 for translational movement along a female housing 200 (refer to FIGS. 2-5).

Disposed between the pair of arms 110 is a center arm 130 extending from the body portion 105 in the longitudinal direction. The center arm 130 comprises a groove 140 on an underside thereof. The end of the center arm 130 farthest from the body portion 105 is shaped such that an inclined plane 135 is formed that bends towards the groove 140. The groove 140 is configured to mate with a protrusion 210 of a female housing 200 (refer to FIG. 3) in a pre-lock position. Additionally, each of the parallel arms 110 comprises a side latch 150 that extends for a length lateral to the longitudinal direction, and the side latches 150 are configured to lock onto corresponding lips 205 on the female housing 200 (refer to FIG. 3) in the pre-lock position. When a male housing 300 is inserted in the female housing 200, a header edge 310 (refer to FIG. 3) of the male housing 300 comes into translational contact with the inclined plane 135, and forces the center arm 130 to move in an upward direction to release the groove 140. The side latches 150 also disengage from the corresponding lips 205 so that the CPA device 100 is able to proceed to the final-lock position. The CPA device 100 also includes a lever lock 155 configured to movement of the CPA device 100 in the final-lock position.

The pre-lock position of the CPA device 100, in accordance with one or more embodiments of the present invention, and as employed in conjunction with a connector assembly, is described with reference to FIG. 2.

Figure 2:
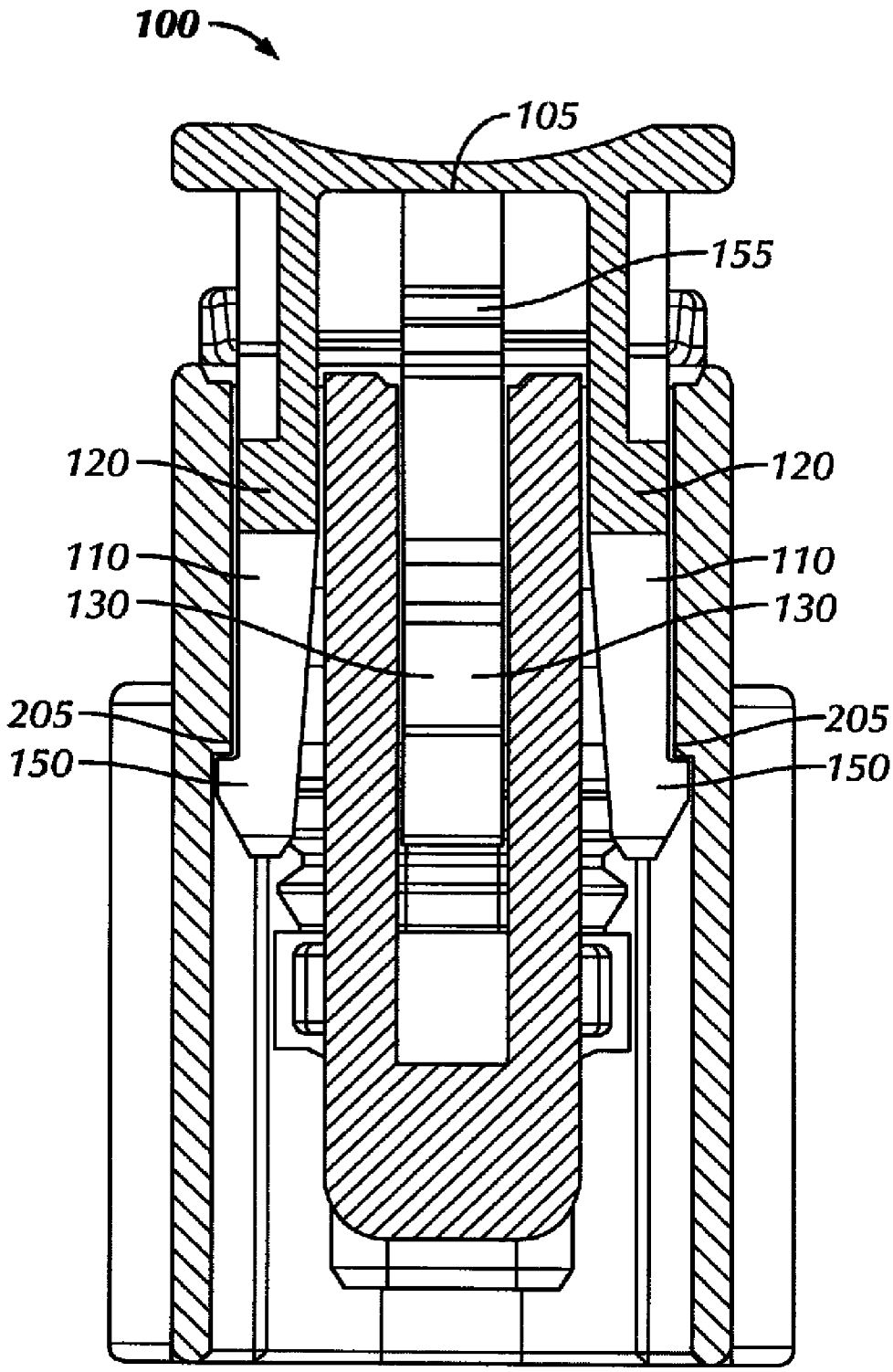
FIG. 2 is a cross-sectional top view of the CPA device mounted on a connector device in a pre-lock position in accordance with one or more embodiments of the invention.

FIG. 2 is a cross-sectional top-view of the CPA device 100 engaged with the female housing 200 in the pre-lock position. The space between the pair of arms 110 and the center arm 130 forms another channel for receiving complementary elements of the female housing 200. Once translational motion or relative translational motion of the CPA device 100 and the female housing 200 leads to the pre-lock position shown in FIG. 2, the CPA device 100 is rendered conditionally immobile, where immobility is caused by the groove 140 under the center arm 130 locking onto a protrusion 210 on the female housing 200, and the side latches 150 of the pair of arms 110 latching onto corresponding lips 205 on the female housing 200.

Figure 3:
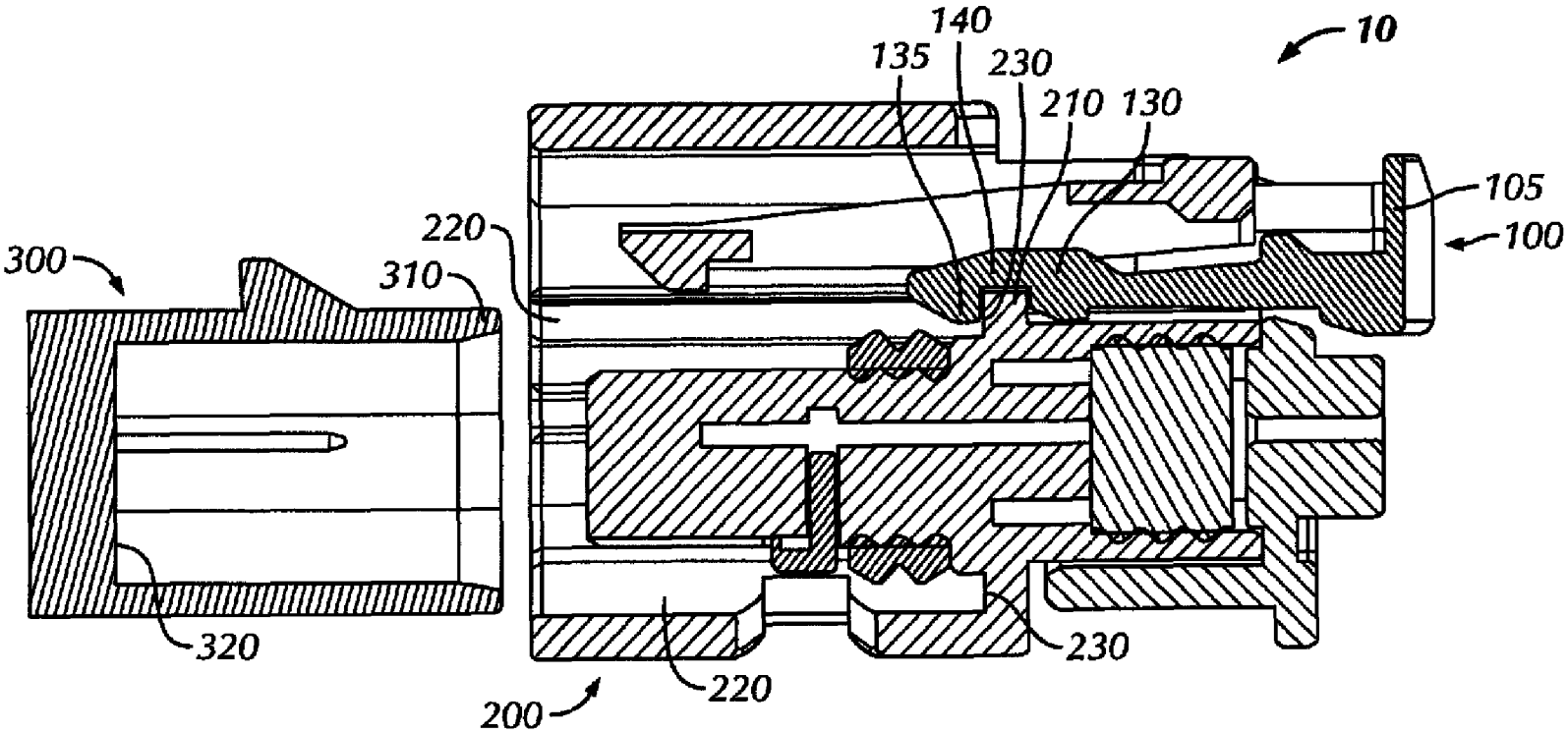
FIG. 3 is a cross-sectional front view of the connector assembly including a CPA device in accordance with one or more embodiments of the invention, where the CPA device is in the pre-lock position.
Figure 4:
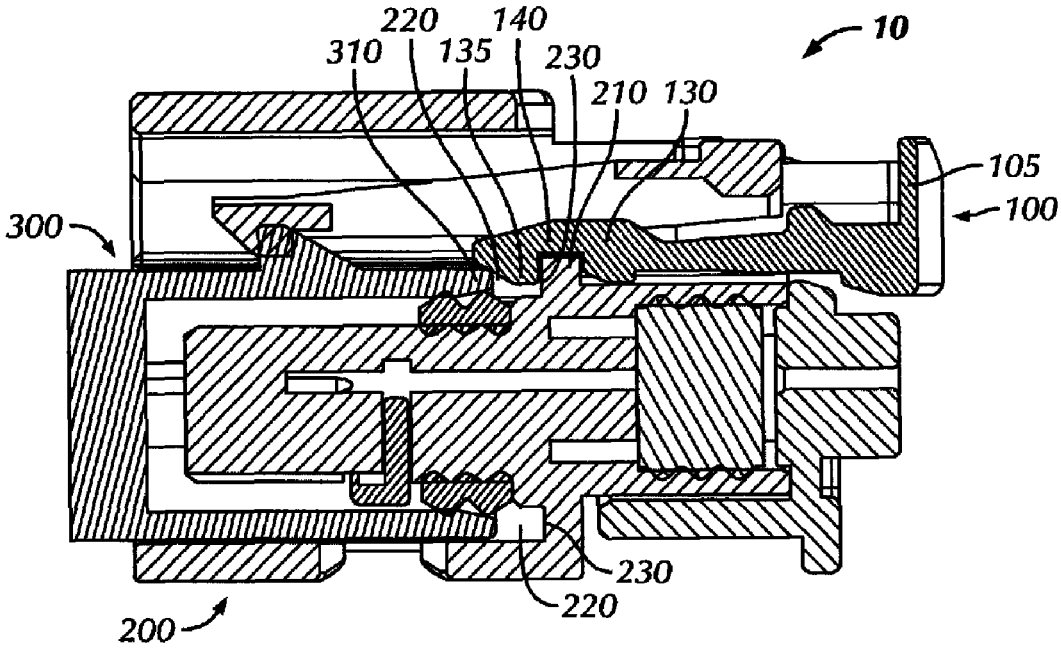
FIG. 4 is a cross-sectional front view of the connector assembly including the CPA device in accordance with one or more embodiments of the invention, where the CPA device is about to be dislodged from the pre-lock position.
Figure 5:
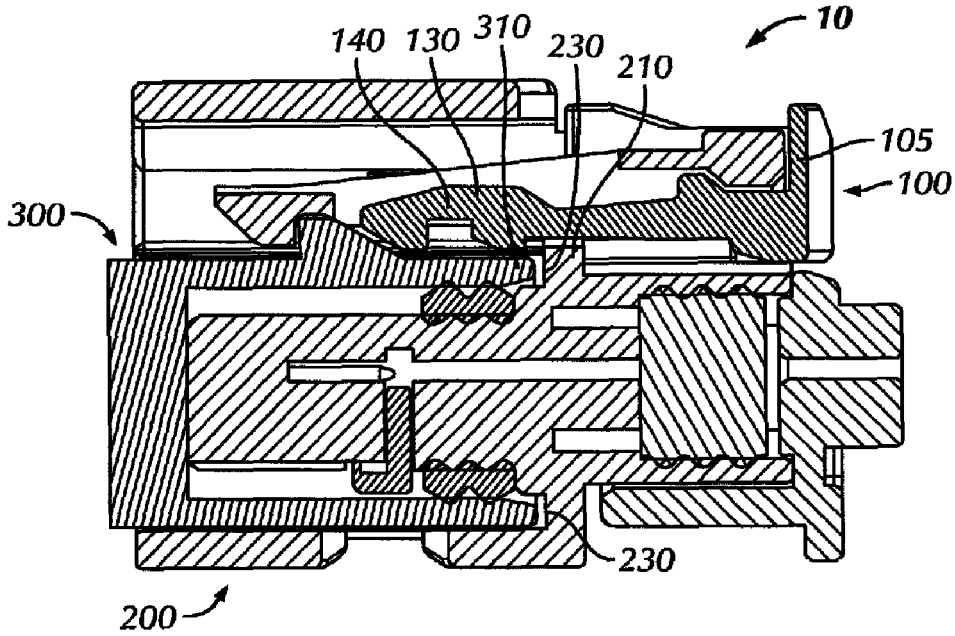
FIG. 5 is a cross-sectional front view of the connector assembly including the CPA device in accordance with one or more embodiments of the invention, where the CPA device is in the final lock position.

FIGS. 3-5 are cross-sectional front-views of the connector assembly 10, which includes a female housing 200 having a cavity 220, and a male housing 300 configured to mate with the female housing 200 by way of the cavity 220, in various stages of locking. The CPA device 100 and the male housing 300 hold the connector assembly 10 together in the fully-mated state.

FIG. 3 is a cross-sectional front-view of the connector assembly 10, showing the center arm 130 in the pre-lock position. The male housing 300 is not yet introduced inside the cavity 220 of the female housing 200. As shown in FIG. 4, the male housing 300 is inserted into the female housing 200 in a direction opposite to the direction in which the CPA device is inserted into the female housing 200. Upon translational contact of a header edge 310 of the male housing 300 with the inclined plane 135 of the edge of the center arm 130 of the CPA device 100, a portion of the center arm 130 moves slightly upward to release the groove 140 from the protrusion 210, and the side latches 150 disengage from the corresponding lips 205, leading to the surmounting of the conditional immobility and freeing of the CPA device 100 from the pre-lock position. This allows for continued translation of the CPA device 100 relative to the female housing 200 and the male housing 300.

Just prior to full insertion of the CPA device 100 into the female housing 200, the CPA device 100 moves slightly upward, and the channel formed by the guide elements 120 and the pair of arms 110 accommodates complete translation of the female housing 200. Thereinafter, the lever lock 155 of the CPA device 100 prevents downward movement of the CPA device 100 by locking onto an element of the female housing 200, and the CPA device 100 is in the final-lock position of immobility. Additionally, the mating interface 230 on the female housing 200 now serves to limit a passage 220 in the female housing 200 for the male housing 300 in the final-lock position.

Figure 6:
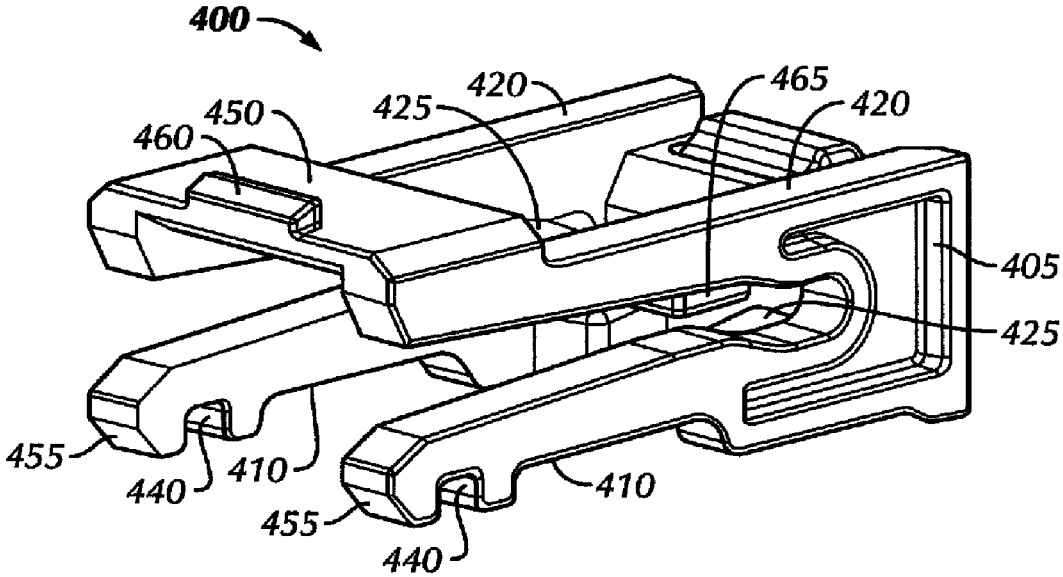
FIG. 6 is a perspective view of a Connector Position Assurance (CPA) device in accordance with one or more embodiments of the invention.

As shown in FIG. 6, in one or more embodiments, the CPA device 400 includes guide elements 420 for forming a channel 425 and an integrally formed rectangular portion 450, which connects the guide elements 420 proximate the end farthest from the body portion 405. The guide elements 420 are attached to the body portion 405 and extended in the longitudinal direction parallel to the arms 410. The rectangular portion 450 also comprises a latching element 460 integrally formed as a shaped relief on top of the rectangular portion 450 and at the edge of the end farthest from the body portion 405. The two arms 410 each comprise a groove 440 on an underside thereof, and the ends of the arms 410 farthest from the body portion 405 are shaped into inclined planes 455. In the pre-lock position, the grooves 440 are configured to mate with a protrusion 510 on the female housing 500, and the latching element 460 latches onto a lip 520 of the female housing 500. Upon translational contact of the inclined planes 455 with header edges 610 of the male housing 600, the two arms 410 move in an upward direction to release the grooves 440 and the latching element 460 disengages from the corresponding lip 520 in order for the CPA device 400 to proceed to the final-lock position (refer FIGS. 7-9). The CPA device 400 also includes a lever lock 465 configured to movement of the CPA device 400 in the final-lock position.

The various stages of locking of the connector assembly 40, in accordance with one or more embodiments of the invention, are described with reference to FIGS. 7-9.

Figure 7:
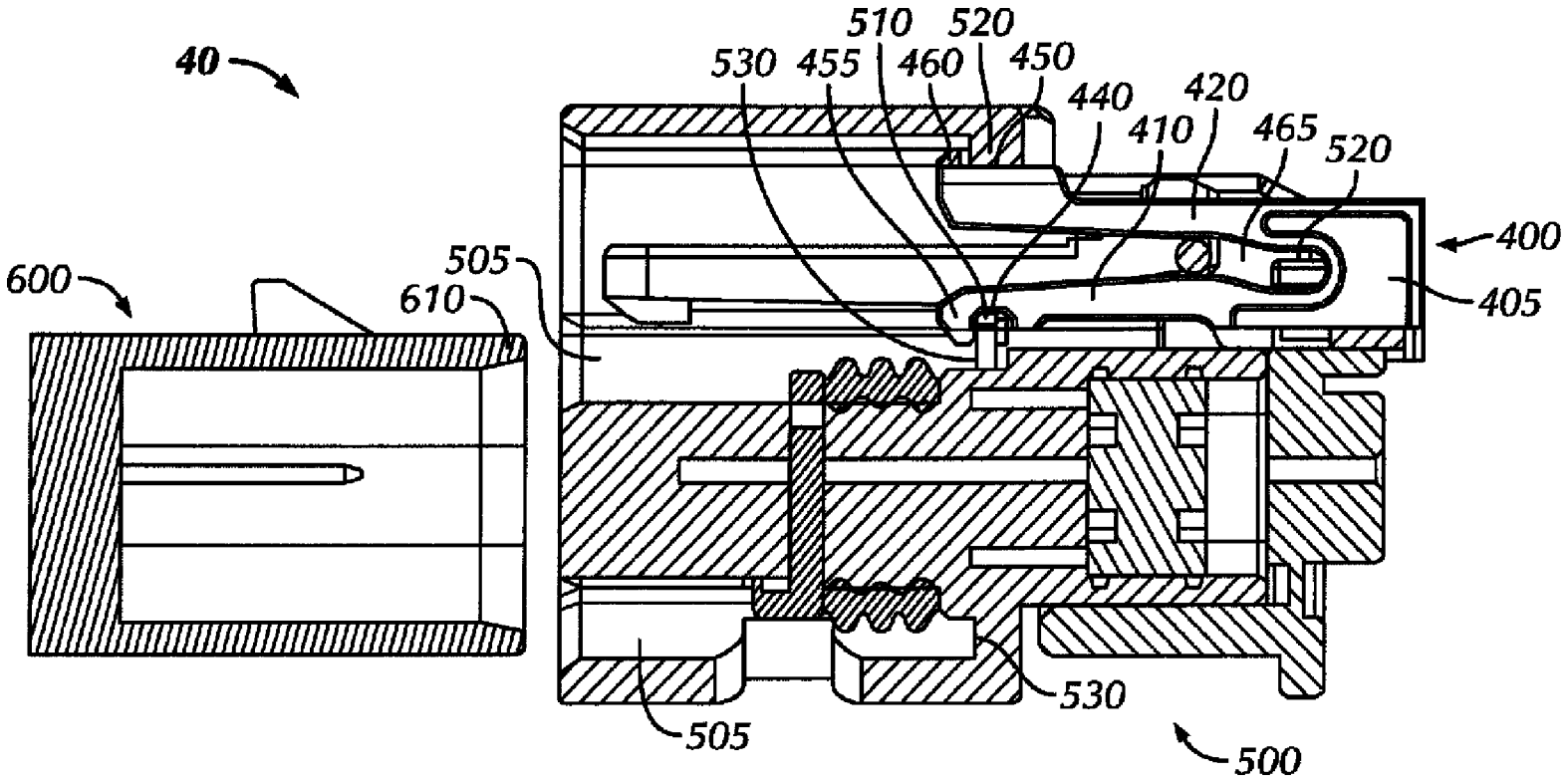
FIG. 7 is a cross-sectional front view of the connector assembly including a CPA device in accordance with the one or more embodiments of the invention, where the CPA device is in the pre-lock position.

FIG. 7 is a cross-sectional front-view of the CPA device 400 mounted over a female housing 500 in the pre-lock position. The male housing 600 is not yet introduced inside the cavity 505 of the female housing 500. The space between the pair of arms forms a channel 425 for receiving complementary elements of the female housing 500. Once translational motion or relative translational motion of the CPA device 400 and the female housing 500 leads to the pre-lock position shown in FIG. 7, the CPA device 400 is rendered conditionally immobile. The immobility is caused by the grooves 440 under the pair of arms 410 instead of the center arm 130 in the exemplary embodiment shown in FIG. 1. The grooves 440 find complementary protrusions 510 on the female housing 500 to lock onto and the latching element 460 on the rectangular portion 450 of the CPA device 400 also latches onto a corresponding lip 520 on the female housing 500.

Figure 8:
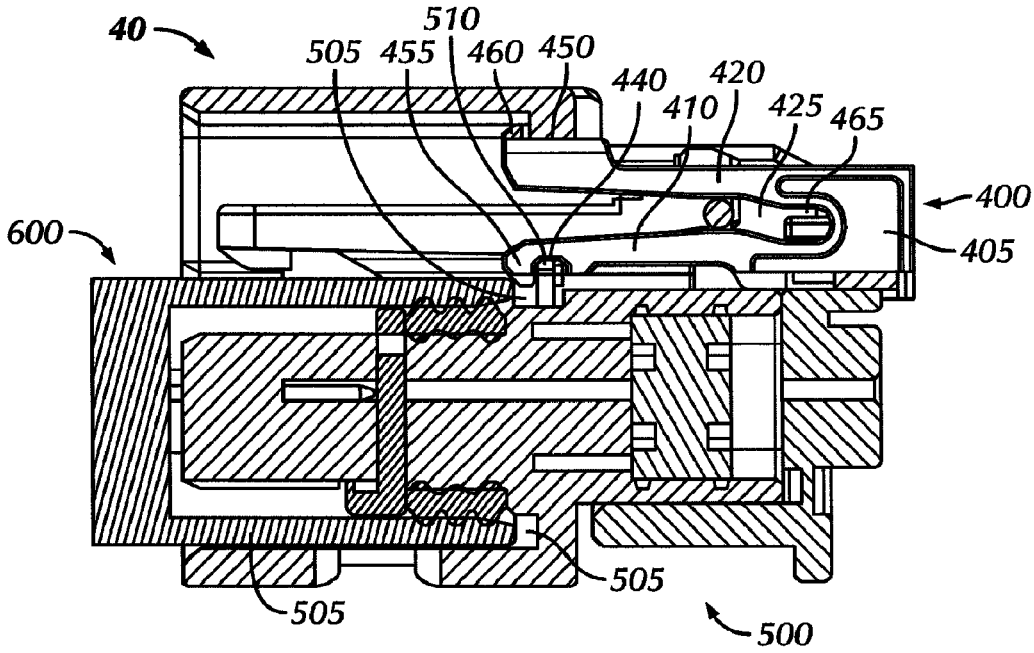
FIG. 8 is a cross-sectional front view of the connector assembly including the CPA device in accordance with one or more embodiments of the invention, where the CPA device is about to be dislodged from the pre-lock position.
Figure 9:
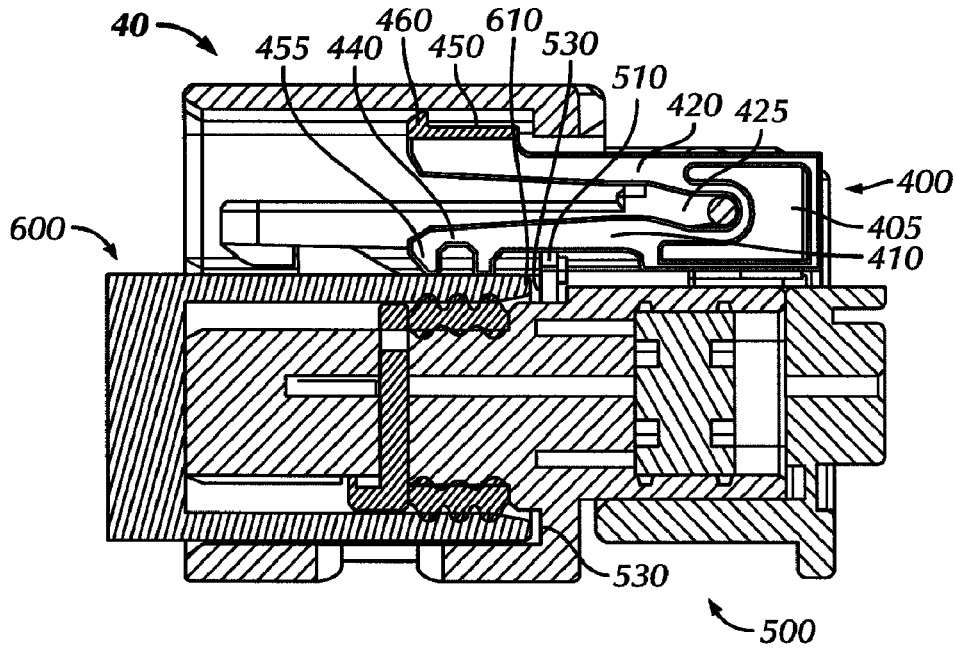
FIG. 9 is a cross-sectional front view of the connector assembly including the CPA device in accordance with one or more embodiments of the invention, where the CPA device is in the final lock position.

As shown in FIG. 8, the male housing 600 is inserted into the female housing 500 in a direction opposite to the direction in which the CPA device is inserted into the female housing 500. The conditional immobility is surmounted only when two header edges 610 of the male housing 600 come into contact with the inclined planes 455 of the edges of the pair of arms 410 of the CPA device 400. The contacting of the inclined planes 455 of the edges of the pair of arms 410 by the two header edges 610 causes an upward movement of a portion of said pair of arms 410 so as to release the grooves 440 from the complementary protrusions 510. The latching element 460 also disengages from the corresponding lip 520. This allows for continued translation of the CPA device 400 relative to the connector device 500 until full insertion into the female housing occurs, as shown in FIG. 9.

Just prior to full insertion, the CPA device 400 moves slightly upward, the channel 425 formed by the guide elements 420 and the pair of arms 410 accommodates complete translation of the female housing 500, and the lever lock 465 prevents downward movement of the CPA device 100 by locking onto an element of the female housing 500. Thus, further motion of the connector device 500 is prevented in the final-lock position. Additionally, the rectangular portion 450 of the CPA device 400 also serves to prevent motion of the female housing 500. The mating interface 530 on the female housing 500 now serves to limit a passage 505 in the female housing 500 for the male housing 600 in the final-lock position.

It will be apparent to one of ordinary skill in the art that the specific shapes and structures of individual elements of the CPA device can be modified easily, and as such the above detailed description should not be considered limiting.

Advantages of one or more embodiments of the invention may include one or more of the following. In accordance with one or more embodiments of the invention, the lever lock can remain disengaged with the CPA device at the pre-lock position. This reduces unwanted damage to the connector assembly elements. The CPA device can be disengaged from the pre-lock position by an edge of the header only when the male and female housings are fully mated. If the connector parts are not mated properly, the impropriety can be detected easily because the CPA device will not be able to proceed to the final lock position.

In one or more embodiments of the invention, the CPA device is in a deformation/stress-free state at both pre-lock and final lock positions. Permanent deformation due to material creep, which can be worsened under prolonged exposure to high operating temperatures, can thereby be prevented. The stress-free state is achieved through bidirectional translations between the pre-lock and final lock positions, which offset the height difference between these positions. Retention of the assembly in the connected state is achieved through the CPA design, and accidental disengagement of connector assembly is prevented by the effect of the CPA design, i.e., the CPA device is designed to prevent movement of the lever lock at the final lock position.

While the invention has been described with respect to a limited number of exemplary embodiments, the invention is not limited. Those of ordinary skill in the art will recognize that various modifications to the embodiments shown may be made without departing from the scope of the invention. Accordingly, the invention shall be considered limited only by the scope of the appended claims.

What is claimed is:

1. A Connector Position Assurance (CPA) device for ensuring mating of a male header connector with a female housing, the CPA device comprising:

a body portion;

a first arm attached to the body portion, extending from the body portion, and comprising a locking groove proximate a distal end thereof; and a second arm attached to the body portion spaced apart from the first arm, extending from the body portion, and comprising a locking latch, wherein the CPA device has a pre-lock position and a final-lock position within the female housing, wherein the CPA device enters the pre-lock position upon partial insertion into a back side of the female housing such that:

the locking groove engages a first protrusion on the female housing, and the locking latch engages a second protrusion on the female housing, and wherein the CPA device enters the final-lock position upon insertion of the male header connector into a front side of the female housing such that:

the locking groove and the locking latch are disengaged from the pre-lock position through contact of a sloped surface at the distal end of the first arm with a leading edge of the male header connector, and wherein, when the CPA device is in the final-lock position, the male header connector is in a completely-mated state with the female housing.

2. The CPA device of claim 1, wherein disengagement from the pre-lock position through contact of a sloped surface at the distal end of the first arm with a leading edge of the male header connector occurs by way of at least a portion of the first arm rising upward in a direction perpendicular to a direction of insertion of the male header connector into the female housing.

3. The CPA device of claim 1, wherein the body portion is planar in a direction perpendicular to the first arm and the second arm.

4. The CPA device of claim 3, wherein the locking groove is on an underside of the first arm.

5. The CPA device of claim 4, wherein the locking groove is cuboidal in shape.

6. The CPA device of claim 5, wherein the sloped surface at the distal end of the first arm is proximate the locking groove.

7. The CPA device of claim 1, wherein the first arm and the second arm are spaced apart in the first direction.

8. The CPA device of claim 7, wherein the locking latch on the second arm extends in a lateral direction perpendicular to both the direction of insertion and the upwards direction.

9. The CPA device of claim 8, wherein the CPA device further comprises two second arms, wherein one second arm is disposed on each side of the first arm.

10. The CPA device of claim 9, wherein the CPA device further comprises two guide elements protruding from the body portion, each extending above one second arm, and spaced from the arm in the upwards direction, wherein spaces between the arms and the guide elements are formed as channels for translational sliding of complementary portions of the female housing.

11. The CPA device of claim 10, wherein the guide elements extend to a length less than the length of the second arms.

12. The CPA device of claim 11, wherein the CPA device further comprises a lever lock disposed between the two second arms proximate the body portion, wherein the lever lock is configured to lock onto an element of the female housing to prevent movement of the CPA device in the final lock position.

13. The CPA device of claim 1, wherein the first arm and the second arm are spaced apart in the upwards direction.

14. The CPA device of claim 13, wherein the CPA device comprises two sets of the first arm and the second arm such that individual sets are spaced apart in the direction of insertion.

15. The CPA device of claim 14, wherein the locking latch is shared by each of the two second arms of the two sets by way of the two second arms being integrally connected by a rectangular portion proximate ends farthest from the body portion, the locking latch being formed on said rectangular portion.

16. The CPA device of claim 15, wherein the locking latch is a shaped relief.

17. The CPA device of claim 15, wherein the first arms and the second arms of the two sets are configured to guide complementary portions of the female housing during relative translational motion.

18. The CPA device of claim 17, wherein the CPA device further comprises a lever lock disposed between the two sets of arms proximate the body portion, wherein the lever lock is configured to lock onto an element of the female housing to prevent movement of the CPA device in the final lock position.

19. A connector assembly defining a pre-lock position and a final-lock position, the connector assembly comprising:

a female housing;

a CPA device configured to be inserted into the female housing in a first direction; and a male housing configured to be inserted into the female housing in a second direction opposite to the first direction, wherein the CPA device comprises:

a body portion;

a first arm attached to the body portion, extending from the body portion, and comprising a locking groove proximate a distal end thereof; and a second arm attached to the body portion, spaced apart from the first arm, extending from the body portion, and comprising a locking latch, wherein, when the CPA device is inserted into the female housing, the locking groove of the first arm locks onto a first protrusion on the female housing and the locking latch of the second arm latches onto a second protrusion on the female housing in the pre-lock position, wherein, when the male housing is inserted into the female housing after the pre-lock position of the CPA device, a leading edge of the male housing comes in contact with a sloped surface at the distal end of the first arm of the CPA device and forces a portion of the first arm to rise in a direction perpendicular to the first direction and the second direction to disengage the locking groove of the first arm from the first protrusion on the female housing and the locking latch of the second arm from the second protrusion on the female housing such that the pre-lock position is ended, and wherein, when the CPA device is guided further into the female housing after the pre-lock position is ended, relative motion between the CPA device and the female housing is prevented by the body portion of the CPA device such that the CPA device is in a complete-mated state with the female housing and the male header connector.

20. The connector assembly of claim 19, wherein the CPA device is in an undeformed state in both the pre-lock position and the final lock position.

21. The connector assembly of claim 19, wherein a mating interface on the female housing serves to limit a passage in the female housing for the male header connector in the final-lock position.

* * * * *